US006415863B1

(12) United States Patent
Hudson et al.

(10) Patent No.: US 6,415,863 B1
(45) Date of Patent: Jul. 9, 2002

(54) APPARATUS AND METHOD FOR HANGING TUBULARS IN WELLS

(75) Inventors: Leo D. Hudson; Jefferey D. Herndon, both of Bakersfield, CA (US)

(73) Assignee: Bestline Liner System, Inc., Bakersfield, CA (US)

( * ) Notice: Subject to any disclaimer, the term of this patent is extended or adjusted under 35 U.S.C. 154(b) by 0 days.

(21) Appl. No.: 09/262,665

(22) Filed: Mar. 4, 1999

(51) Int. Cl.[7] ..... E21B 33/04
(52) U.S. Cl. ..... 166/208; 72/392; 166/217
(58) Field of Search ..... 166/206, 208, 166/216, 217, 277, 382; 72/260, 264, 370.06, 370.07, 370.08, 370.24, 392

(56) References Cited

U.S. PATENT DOCUMENTS

| | | | | |
|---|---|---|---|---|
| 2,017,451 A | | 10/1935 | Wickersham | 116/10 |
| 2,214,226 A | | 9/1940 | English | |
| 2,245,471 A | | 6/1941 | Garvin | 192/20 |
| 2,377,249 A | | 5/1945 | Lawrence | 294/86 |
| 2,732,901 A | | 1/1956 | Davis | 166/98 |
| 2,734,581 A | | 2/1956 | Bonner | 166/98 |
| 2,965,175 A | | 12/1960 | Ransom | 166/98 |
| 2,984,302 A | | 5/1961 | Church | 166/98 |
| 3,067,819 A | * | 12/1962 | Gore | 166/207 X |
| 3,179,168 A | | 4/1965 | Vincent | |
| 3,186,485 A | | 6/1965 | Owen | 166/63 |
| 3,191,677 A | | 6/1965 | Kinley | |
| 3,203,483 A | | 8/1965 | Vincent | 166/207 |
| 3,245,471 A | | 4/1966 | Howard | |

(List continued on next page.)

FOREIGN PATENT DOCUMENTS

| | | |
|---|---|---|
| CA | 1153322 | 9/1983 |
| CA | 1157689 | 11/1983 |
| CA | 1158682 | 12/1983 |
| CA | 1170921 | 7/1984 |
| CA | 1176040 | 10/1984 |
| CA | 1191436 | 8/1985 |
| CA | 1192029 | 8/1985 |
| CA | 1193526 | 9/1985 |
| CA | 1213761 | 11/1986 |
| CA | 1217415 | 2/1987 |
| DE | 203767 | 11/1983 |
| SU | 16686125 A1 | 10/1991 |

*Primary Examiner*—George Suchfield
(74) *Attorney, Agent, or Firm*—Lyon & Lyon LLP

(57) ABSTRACT

A hanger for use in joining tubulars includes an inner tubular with a first portion of length with increasing wall thickness and a second portion of length with decreasing wall thickness through the same longitudinal direction. A swedge sized to expand the inner tubular beyond the yield point to engage and expand the outer tubular is to be drawn through the inner tubular. With the variation in wall thickness, the outer tubular is progressively expanded in an increasing manner and then in a decreasing manner. The difference in inelastic expansion operates to insure an appropriate ultimate fit at one or two areas between the overlapping tubulars. The inner tubular may include a nipple affixed to a liner or may include a liner with an outer filler. In one case, the nipple has varying wall thickness while in the other the filler exhibits the varying wall thickness. A segmented swedge includes portions of the part lines between adjacent segments which are circumferential. Shear elements extend across the circumferential sections to hold the swedge together.

10 Claims, 2 Drawing Sheets

U.S. PATENT DOCUMENTS

| | | | | | |
|---|---|---|---|---|---|
| 3,326,293 | A | | 6/1967 | Skipper | 166/150 |
| 3,353,599 | A | | 11/1967 | Swift | |
| 3,412,565 | A | | 11/1968 | Lindsey et al. | |
| 3,477,506 | A | | 11/1969 | Malone | 166/207 |
| 3,489,220 | A | | 1/1970 | Kinley | 166/277 |
| 3,583,200 | A | | 6/1971 | Cvijanovic et al. | 72/393 |
| 3,669,190 | A | | 6/1972 | Sizer et al. | |
| 3,691,624 | A | | 9/1972 | Kinley | 29/523 |
| 3,712,376 | A | | 1/1973 | Owen et al. | 166/277 |
| 3,746,091 | A | | 7/1973 | Owen et al. | 166/207 |
| 3,776,307 | A | | 12/1973 | Young | 166/125 |
| 3,780,562 | A | | 12/1973 | Kinley | 72/479 |
| 3,948,321 | A | | 4/1976 | Owen et al. | 166/277 |
| RE30,802 | E | | 11/1981 | Rogers, Jr. | 29/421 R |
| RE30,988 | E | * | 7/1982 | Crickmer | 166/217 X |
| 4,359,889 | A | | 11/1982 | Kelly | 72/62 |
| 4,362,324 | A | | 12/1982 | Kelly | 285/119 |
| 4,382,379 | A | | 5/1983 | Kelly | 73/46 |
| 4,387,502 | A | | 6/1983 | Dom | 29/568 |
| 4,407,150 | A | | 10/1983 | Kelly | 72/61 |
| 4,414,739 | A | | 11/1983 | Kelly | 29/727 |
| 4,445,201 | A | | 4/1984 | Pricer | 365/154 |
| 4,450,612 | A | | 5/1984 | Kelly | 72/62 |
| 4,470,280 | A | | 9/1984 | Kelly | 72/61 |
| 4,483,399 | A | | 11/1984 | Colgate | 166/308 |
| 4,487,630 | A | | 12/1984 | Crook et al. | 75/123 B |
| 4,502,308 | A | | 3/1985 | Kelly | 72/58 |
| 4,505,017 | A | | 3/1985 | Schukei | 29/157.3 R |
| 4,505,142 | A | | 3/1985 | Kelly | 72/54 |
| 4,505,612 | A | | 3/1985 | Shelley, Jr. | 405/101 |
| 4,567,631 | A | | 2/1986 | Kelly | 29/157.3 C |
| 4,581,617 | A | | 4/1986 | Yoshimoto et al. | 346/108 |
| 4,767,310 | A | | 8/1988 | Neumann et al. | 425/469 |
| 4,793,382 | A | | 12/1988 | Szalvay | 138/98 |
| 4,830,109 | A | | 5/1989 | Wedel | 166/277 |
| 4,976,322 | A | | 12/1990 | Abdrakhmanov et al. | 175/57 |
| 5,070,941 | A | | 12/1991 | Kilgore | 166/98 |
| 5,307,879 | A | | 5/1994 | Kent | 166/382 |
| 5,348,095 | A | | 9/1994 | Worral et al. | 166/380 |
| 5,366,012 | A | | 11/1994 | Lohbeck | 166/277 |
| 5,697,439 | A | * | 12/1997 | Kopfman et al. | 166/88.3 |
| 5,785,120 | A | | 7/1998 | Smalley et al. | 166/55 |
| 5,787,933 | A | | 8/1998 | Russ et al. | 138/98 |
| 5,794,702 | A | | 8/1998 | Nobileau | 166/380 |
| 5,857,524 | A | | 1/1999 | Harris et al. | 166/382 |

* cited by examiner

APPARATUS AND METHOD FOR HANGING TUBULARS IN WELLS

BACKGROUND OF THE INVENTION

The field of the present invention is well drilling and completion systems.

Well drilling and completion equipment includes tubulars which are variously characterized as casing, tubing and liner. For universal application, they are cylindrical in shape and of a length in compliance with the American Petroleum Institute Standard 5C. The term "casing" is typically applied to tubulars which are larger in diameter and used to support the earth's encroachment when drilling a bore hole for a well. Often casing is cemented to the bore hole to define a sound structural member and to prevent migration of unwanted gases, water or other fluids outwardly of the casing. Casing is typically assembled from 40 foot long tubulars with threaded couplings. Wells can extend for several miles into the earth. As the well increases in depth, the hydraulic pressures to which the casing is subjected to increase. Decreases in casing diameter with increasing depth is common, often to avoid experiencing excessive force from such high pressures. Such decreases typically occur in step function as smaller casing is employed.

"Liner" is typically made up of tubulars in an area of well production. Liner can have portions with slots prefabricated through the wall, end closure elements and the like. Liner is typically smaller in diameter than casing and is typically placed in wells after casing to extend from casing into production zones.

Other tubing may be employed within casing to bring production to the surface and for other communication within wells. This too is placed in wells after casing and has a reduced diameter.

To insure the flow of fluids with or without entrained solids are appropriately directed within wells, packers or annular seals are frequently employed to span gaps at radial steps in tubular construction within wells. Packers are also employed to insure the blockage of pressure from unwanted areas.

Additionally, structural support from above frequently is needed for such placements. The compression of tubular strings through placement on the bottom is often considered to be detrimental to the pressure integrity of the structure. Consequently, suspending liner or casing in tension is preferred. Hangers typically are used which employ wedges or other structural devices to grip the inner tubular. Combinations of packers and hangers are also used.

A system of expanding inner tubulars to act as hangers has been proposed. Reference is made to U.S. patent application Ser. No. 08/947,069, filed Oct. 8, 1997, the disclosure of which is incorporated herein by reference. Such devices employ swedges for expanding the interior element. In addition to the swedges disclosed in the aforementioned application, reference is also made to U.S. patent application Ser. No. 09/085,659, filed May 28, 1998, the disclosure of which is incorporated herein by reference. In addition, substantial hydraulic forces are required to draw such swedges through an interior cylindrical element with substantial interference. Hydraulic rams are disclosed in U.S. patent application Ser. No. 09/115,561, filed Jul. 15, 1998, the disclosure of which is incorporated herein by reference.

In using the casings and liners typically employed in the drilling of wells, great variation can be encountered even if the tubulars comply with the American Petroleum Institute Standard 5C. Variations from the nominal occur both during fabrication and through wear of the tubulars in place. Accommodation of these variations can insure the integrity of the coupling between hangers.

SUMMARY OF THE INVENTION

The present invention is directed to hangers and the methods of use thereof for tubulars in wells. The hangers use inelastic expansion for retention within the outer tubulars. There are variations from the nominal inside diameter in standard tubulars used in wells. Progressively increasing expansion of the outer tubulars as swedges are pulled through the hangers accommodates such variations.

In a first separate aspect of the present invention, a hanger for use in outer tubulars complying with the American Petroleum Institute Standard 5C includes an inner tubular and a swedge. The inner tubular has increasing wall thickness in a first longitudinal direction through at least a portion thereof. The swedge has an outside maximum diameter which is greater than the inside diameter of the inner tubular at least along part of the portion having increasing wall thickness. The swedge is of sufficient diameter to expand the inner tubular beyond the yield point such that the inner tubular acts to also expand the outer tubular. Elastic recovery of the outer tubular retains the inner tubular.

In a second separate aspect of the present invention, the hanger of the first aspect contemplates a cylindrical tubular liner and a filler with the filler being of increasing wall thickness to define the first portion.

In a third separate aspect of the present invention, the hanger of the first aspect contemplates a nipple having one end internally threaded for receipt of threaded tubulars and the like. The area of increasing wall thickness increases in thickness away from the internally threaded end.

In a fourth separate aspect of the present invention, a hanger for use in outer tubulars includes an inner tubular having increasing wall thickness and a swedge capable of expanding the inner tubular to engage an outer tubular. The increasing wall thickness in a longitudinal direction forces increasing expansion of the outer tubular when the swedge is pulled through the inner tubular. A coating of carbide particles is placed about the outside of the portion of the inner tubular having the increasing wall thickness to increase the force of extraction of the inner tubular from the outer tubular.

In a fifth separate aspect of the present invention, a hanger for use in outer tubulars includes an inner tubular having increasing wall thickness and a swedge capable of expanding the inner tubular to engage an outer tubular. The increasing wall thickness in a longitudinal direction forces increasing expansion of the outer tubular when the swedge is pulled through the inner tubular. The hanger further includes a second portion of decreasing wall thickness with the thicker ends of the first and second portions being closest to one another. A smooth transition through the area of maximum engagement between the inner tubular and the outer tubular is thus effected.

In a sixth separate aspect of the present invention, a segmented swedge having a part lines with circumferential sections receive shear elements across the circumferential sections. This swedge provides for assembly within a tubular.

In a seventh separate aspect of the present invention, combinations of the foregoing aspects of hangers are contemplated.

In a eighth separate aspect of the present invention, the method for hanging a first tubular in a second tubular includes placing the tubulars in overlapping relationship, holding the tubulars in place and expanding some portion of the overlapping tubulars. The inner tubular is expanded circumferentially past the yield point and the outer tubular experiences expansion which increases progressively through a first length of the overlapping tubulars. A further portion of progressively decreasing expansion may also be employed.

Accordingly, it is an object of the present invention to provide hangers and methods of hanging tubulars for wells which accommodate variations from nominal tubular dimensions. Other and further objects and advantages will appear hereinafter.

DETAILED DESCRIPTION OF THE PREFERRED EMBODIMENTS

Figure 1:
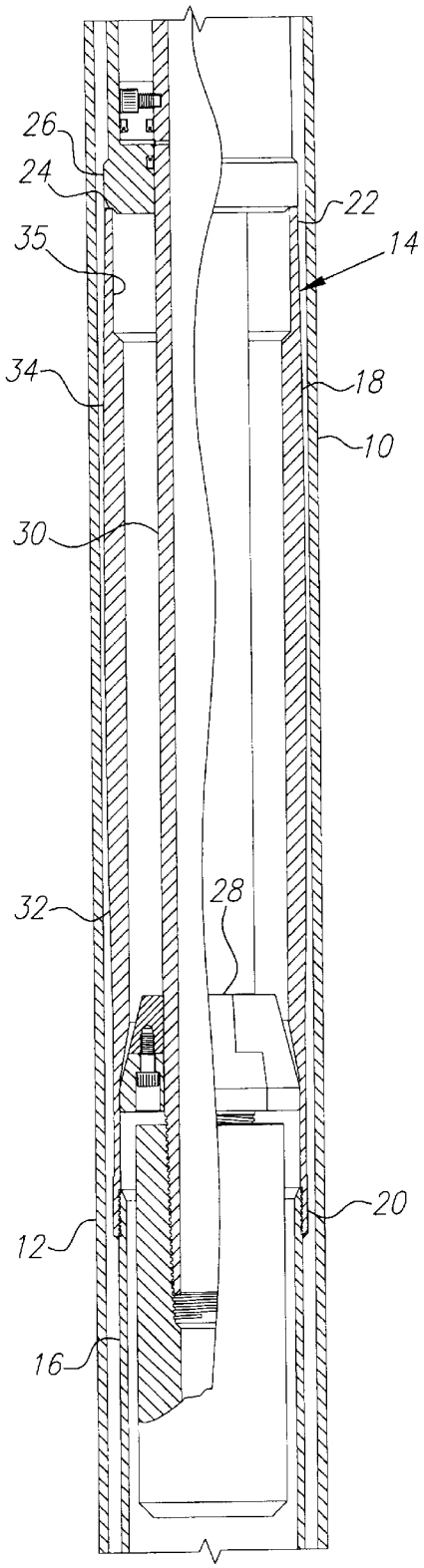
FIG. 1 is a partial cross-sectional view of a first hanger within a casing with a swedge.
Figure 2:
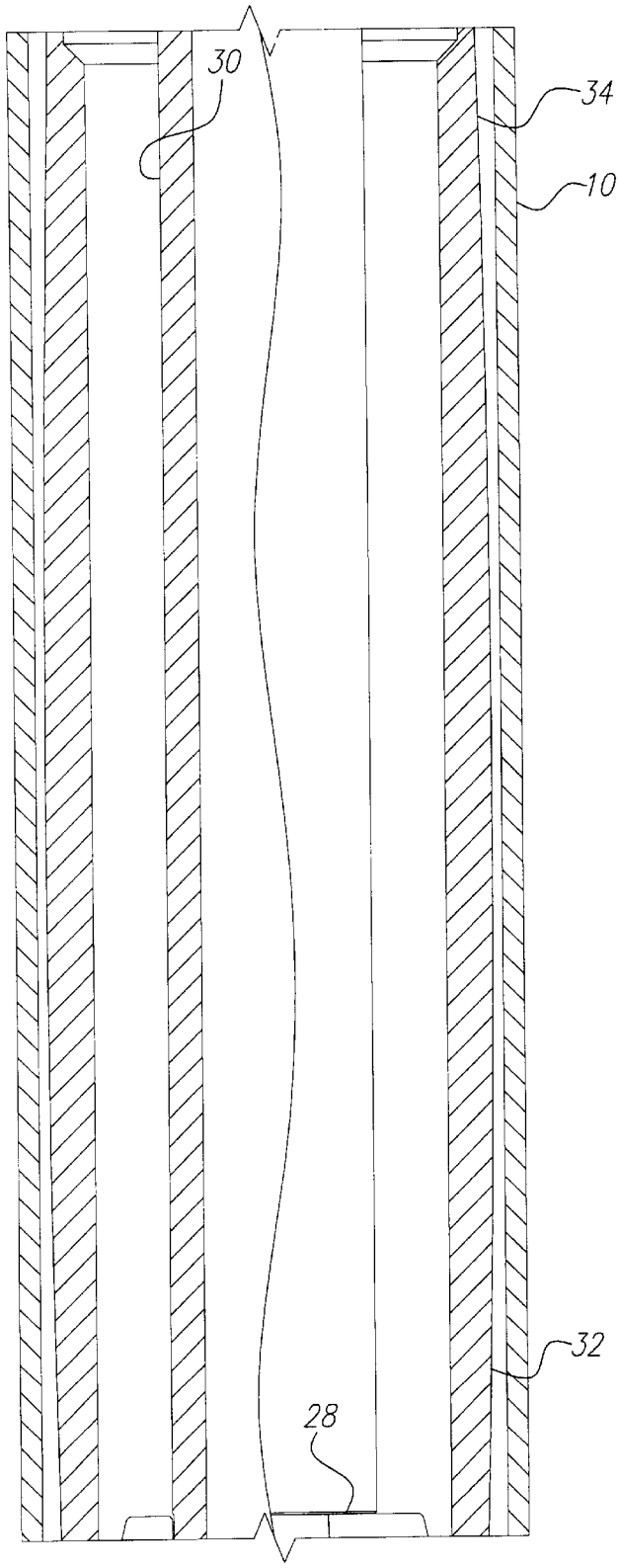
FIG. 2 is an enlarged detail of the center portion of FIG. 1.

Turning in detail to the drawings, FIG. 1 illustrates a tubular, shown to be a casing 10 in this embodiment, understood to be positioned within a well bore (not shown). The lower end 12 of the casing 10 does not exterid to the bottom of the well bore. An assembly for hanging a second tubular, shown to be a liner assembly 14 in this embodiment, within the casing 10 is positioned with the upper end of the liner assembly in an overlapping relationship with the casing 10. This second tubular may be casing, liner or other tubing with a smaller diameter than the first tubular 10 with which it is positioned. The liner assembly 14 extends further into the well an indeterminate distance. The casing 10 as well as a portion of the liner assembly 14 may be drawn from well-drilling stock which are conventional standard tubulars.

The liner assembly 14 is shown in this embodiment to include the liner 16 threaded to a nipple 18. The nipple 18 includes a lower end 20 which is internally threaded. An upper end 22 includes a bearing shoulder 24 for receiving a hydraulic ram 26. The inside diameter of the lower threaded end 20 is not large enough to receive a swedge 28 with clearance. Consequently, the swedge 28 is assembled from pieces. The swedge 28 is associated with a draw bar 30 extending through the nipple 18 and into the hydraulic ram 26.

The body of the nipple 18 is shown to include increasing wall thickness along a first portion 32 of the length of the element. A second portion 34 extends from the first portion 32 and is of decreasing wall thickness in the same longitudinal direction. Consequently, two truncated conical surfaces are shown to abut one another with the ends of the portions 32 and 34 of thin wall thickness being toward the ends 20 and 22 of the nipple 18. The transition between the portions 32 and 34 may be defined by either a continuous surface or a surface having discontinuity at the intersection of the portions. Additionally, the portions 32 and 34 may be displaced from one another with a cylindrical portion therebetween. It is also contemplated, but less preferred, that the inclined surfaces defining the portions of increasing and decreasing wall thickness may be found on the interior of the nipple 18.

The inside diameter of the nipple 18 at least through the portions 32 and 34 is such that the swedge 28 will be in substantial interference. The outside maximum diameter of the swedge 28 finds clearance at the internally threaded end 20 and clearance within the hydraulic ram 26. The remainder of the nipple 18 may be in interference fit to provide for inelastic expansion as the swedge 28 is drawn through by the hydraulic ram 26 acting through the draw bar 30.

The nipple 18 is of substantially incompressible material in the radial direction. In this regard, the material is preferably similar to that of the casing 10. As the nipple 18 expands with the swedge 28 being drawn through the nipple 18, the body of the nipple circumferentially engages the casing 10. The casing 10 is expanded at least elastically by the expanding nipple 18. As the nipple 18 is of varying wall thickness, the casing 10 has progressively increasing expansion along the first portion 32 of the nipple 18 and progressively decreasing expansion along the second portion 34 of the nipple 18. Because of variations in the casing inside diameter and even variations in the range of the outside diameter of the nipple 18, this increasing and decreasing expansion insures that the resulting joint includes one or two areas of maximum resulting interference to prevent extraction of the liner assembly 14 from the casing 10. Further, any possibility that the casing 10 may be weakened in the range of the greatest expansion is mitigated because great holding ability of the nipple 18 would be found to either side of that region of greatest expansion. Thus, vertical load may be carried through both the casing 10 and the body of the nipple 18.

The nipple 18 is shown to include interior diameter relief 35 at the upper end portion. This relief 35 is presented to receive the swedge 28 with clearance or insufficient interference such that the hydraulic ram 26 may be easily withdrawn from the casing 10 once the draw bar 30 and swedge 28 have completed the upward stroke.

The swedge 28 is divided into three segments. The three segments assemble to define a truncated conical section and a cylindrical section as can best be seen in FIG. 1. The part line between the segments is shown to include a circumferential section as well as longitudinal sections. Shear elements such as bolts, pins or other fasteners extend through holes traversing the circumferential portions of each part line. Consequently, the swedge 28 can be placed into the nipple 18 in pieces and assembled in place.

Figure 3:
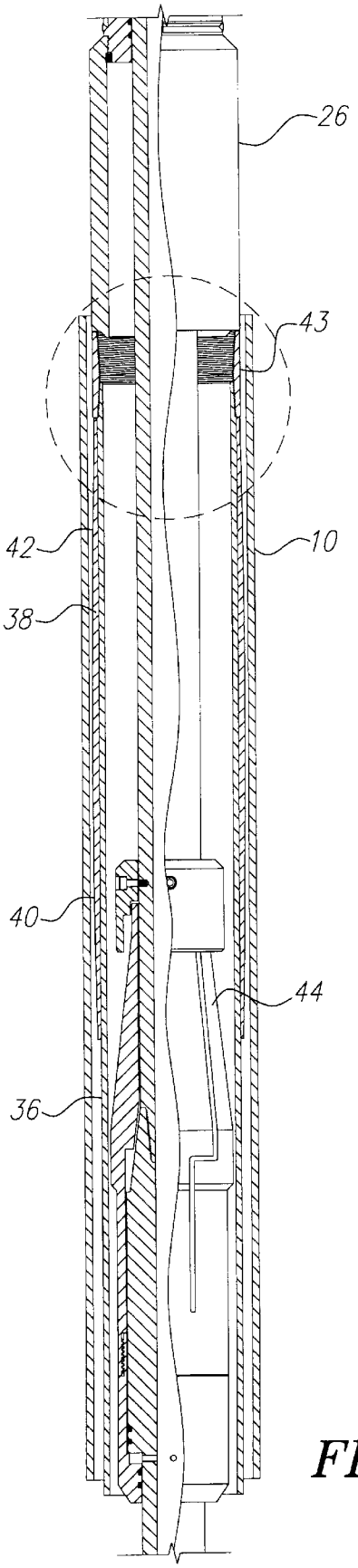
FIG. 3 is a partial cross-sectional view of a second hanger within a casing with a swedge.
Figure 4:
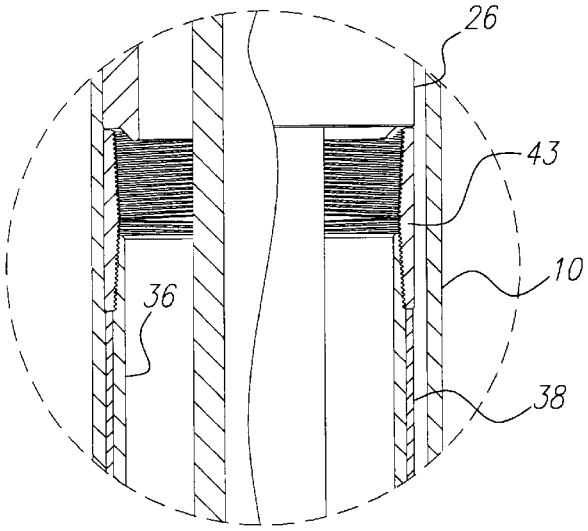
FIG. 4 is an enlarged detail of the circled portion of FIG. 3.

A second configuration is illustrated in FIG. 3. A cylindrical tubular liner 36 is shown to extend to overlapping relationship with the casing 10. A filler 38 is positioned about the cylindrical tubular liner 36 and within the casing 10. The filler 38 includes a first portion 40 of its length which is of increasing wall thickness in one longitudinal direction. A second portion 42 is shown to be in decreasing wall thickness in the same longitudinal direction. Again, the thicker wall portions are abutting or are closest to one another. A collar 43 is threaded to the upper end of the liner 36.

If the liner 36 is of conventional construction with a uniform inside diameter, a variable outer diameter swedge may be employed such as disclosed in the aforementioned application Ser. No. 08/947,069. In this way, areas of increased inside diameter need not be provided to accommodate the swedge 44 prior to its being drawn through the critical area. Again, the inner tubular made up of the cylindrical tubular liner 36 and the filler 38 are arranged with inside diameters such that the passage of the swedge 44 in its expanded state through the inner tubular will result in inelastic circumferential expansion outwardly to engage with and enter into a tight fit with the casing 10. The swedge 44 may be partially or fully expanded below the filler 38 before the liner is placed in the casing to hold the liner 36 until positioned in the well. Specific provision has not been made for relief for the swedge 44 at the end of its stroke. The amount of force needed to extract the swedge 44 through the threaded area is well within the capability of normal drilling equipment. In both embodiments, the casing 10 also expands to a sufficient extent that it will contract and remain in interference fit with the inner tubular after withdrawal of the swedge 28 or 44.

In operation, the inner tubular and the outer tubular are placed in overlapping relationship within a well. The inner tubular may consist of a liner assembly 14 with the nipple 18 positioned in the overlapping relationship or a cylindrical tubular liner 36 with a filler 38 similarly positioned. The inner tubular is then expanded through the operation of the swedge 28 or 44. Because of the increasing and decreasing wall thicknesses of the inner tubular overlapping with the casing 10, the casing 10 is progressively increasing and decreasing in expansion as the swedge passes through these portions. To increase the grip of one component on the other, thin coatings of carbide particles may be employed. The very hard particles embed themselves into the mating components to effectively create engagements with the components.

The inner tubular extends outwardly in both embodiments to expand the casing 10. The assembly is preferably not necessarily selected such that the expansion of the casing 10 remains within the elastic limit of the material. The elastic expansion of the casing 10 is such that, with the swedge withdrawn, the casing 10 is able to rebound enough to remain tight against the inner tubular. Further, it is commonly understood that the materials of oil field tubulars are able to be stretched in the yield range to as much as about 10% to 20% or more without experiencing a significant decrease in strength. Competing effects of work hardening and reduction in cross section accompany the inelastic strain. With continued expansion, the reduction in cross section becomes the dominant factor and strength decreases. The strength of concern is typically the longitudinal tensile strength of the tubular.

When expanded, the inner tubular expands more than the outer tubular per unit of circumference. Likewise, when recovering after the load is removed, the inner tubular will shrink less than the outer tubular to achieve the same ratio of recovery. Consequently, the outer tubular will remain in some tension and the inner tubular will remain in some compression if the two are expanded with the inner tubular expanding in excess of the yield point enough so that the inner tubular cannot recover to a position where tension is removed from the outer tubular. In other words, the outer tubular may remain within the elastic limit but is preferably expanded enough so that its recovery when unloaded by the tubular expander is at least as great as the recovery of the inner tubular. A minimum expansion of both tubulars is preferred to achieve this result. Expansion to the point that a tubular begins to lose strength is avoided except in unusual applications.

To provide some understanding of the magnitudes of interference and expansion and yet not suggest a necessity for the related specific magnitudes, a 9-⅝ casing having a relaxed inside diameter of 8.940" was assembled with a nipple having an outside diameter of 8.250". The relaxed inside diameter of the nipple was 6.74" while the maximum outside diameter of the swedge employed was 7.633". The action of the swedge in this example will force the inner tubular outwardly by approximately 0.884". The wall thickness of the inner tubular will decrease with that expansion. The inner tubular is smaller than the inside diameter of the casing so that the inner tubular may be placed without difficulty. The diametrical gap between the two is nominally 0.690". This gap is sufficiently smaller than the interference between the swedge and the inner tubular at 0.884 so that the inner tubular will be expanded sufficiently to both pass the yield point and expand the casing 10.

A more accurate representation of the fit may be achieved by calculating the volumes. The casing inside diameter volume is 62.740 $in^2$. The outside diameter volume of the nipple is 53.429 $in^2$. The difference is 9.311 $in^2$ which is the volume through which the nipple must move to engage the casing. The swedge outside diameter volume is 45.736 $in^2$ while the nipple inside diameter volume is 35.755 $in^2$. Consequently, the volume moved by the swedge is 9.981 $in^2$. A comparison of the volume moved with the volume to be filled up to achieve contact provides a difference of 0.670 $in^2$. This is the displacement of the nipple into the casing as the swedge progresses through the assembly. The displacement must be sufficient such that the elastic rebound of the casing will maintain the components in appropriate interference fit.

With the foregoing example, the maximum outside diameter of the nipple may be 8.250", in keeping with the maximum calculation above. The inside diameter is constant. At the thin wall ends of the portions, the outside diameter of the nipple may be 8.170". Thus, a diametrical variation of 0.08" is provided to insure accommodation of the variations in component dimensions.

Accordingly, improved hangers and methods of hanging are here disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. A hanger for use in outer tubulars having a nominal inside diameter in compliance with the American Petroleum Institute Standard 5C, comprising an inner tubular including at least a first portion of the length of the inner tubular having continuously increasing wall thickness in a first longitudinal direction;

a swedge having an outside maximum diameter greater than the inside diameter of the inner tubular at least along a part of the first portion which, when in the first portion and displaced from the thicker end of the first portion, expands the inner tubular at the swedge beyond the yield point to engage and expand the outer tubular at the swedge sufficiently that elastic recovery for the inner tubular is less than elastic recovery for the outer tubular with the swedge then removed from the first portion.

2. The hanger of claim 1, the inner tubular including a cylindrical tubular liner and a filler, the filler being around the cylindrical tubular liner and being of increasing wall thickness in a first longitudinal direction.

3. A hanger for use in outer tubulars having a nominal inside diameter in compliance with the American Petroleum Institute Standard 5C, comprising an inner tubular including at least a first portion of the length of the inner tubular having increasing wall thickness in a first longitudinal direction;

a swedge having an outside maximum diameter greater than the inside diameter of the inner tubular at least along a part of the first portion which, when in the first portion and displaced from the thicker end of the first portion, expands the inner tubular at the swedge beyond the yield point to engage and expand the outer tubular at the swedge sufficiently that elastic recovery for the inner tubular is less than elastic recovery for the outer tubular with the swedge then removed from the first portion, the inner tubular including a nipple having one end internally threaded with an inside diameter larger than the outside maximum diameter of the swedge, the one end being most adjacent the end of the first portion having a smaller wall thickness.

4. The hanger of claim 3, the nipple having the first portion of the length with increasing wall thickness.

5. A hanger for use in outer tubulars having a nominal inside diameter in compliance with the American Petroleum Institute Standard 5C, comprising an inner tubular including at least a first portion of the length of the inner tubular having increasing wall thickness in a first longitudinal direction;

a swedge having an outside maximum diameter greater than the inside diameter of the inner tubular at least along a part of the first portion which, when in the first portion and displaced from the thicker end of the first portion, expands the inner tubular at the swedge beyond the yield point to engage and expand the outer tubular at the swedge sufficiently that elastic recovery for the inner tubular is less than elastic recovery for the outer tubular with the swedge then removed from the first portion;

a coating of carbide particles on the outside of the first portion of the inner tubular.

6. A hanger for use in outer tubulars having a nominal inside diameter in compliance with the American Petroleum Institute Standard 5C, comprising an inner tubular including at least a first portion of the length of the inner tubular having increasing wall thickness in a first longitudinal direction;

a swedge having an outside maximum diameter greater than the inside diameter of the inner tubular at least along a part of the first portion which, when in the first portion and displaced from the thicker end of the first portion, expands the inner tubular at the swedge beyond the yield point to engage and expand the outer tubular at the swedge sufficiently that elastic recovery for the inner tubular is less than elastic recovery for the outer tubular with the swedge then removed from the first portion, the inner tubular having a second portion having decreasing wall thickness in the first longitudinal direction, the thicker ends of the first and second portions being closest to one another.

7. A hanger for use in outer tubulars having a nominal inside diameter in compliance with the American Petroleum Institute Standard 5C, comprising an inner tubular including a nipple having a first portion of the length of the nipple being of increasing wall thickness in a first longitudinal direction, having a second portion of the length of the nipple being of decreasing wall thickness in the first longitudinal direction, the thicker ends of the first and second portions being closest to one another and having one end of the nipple being internally threaded, the one end being most adjacent the end of the first portion with a smaller wall thickness;

a swedge having an outside maximum diameter greater than the inside diameter of the inner tubular at least along a part of the first portion which, when in the first portion and displaced from the thicker end of the first portion, expands the inner tubular at the swedge beyond the yield point to engage and expand the outer tubular at the swedge sufficiently that elastic recovery for the inner tubular is less than elastic recovery for the outer tubular with the swedge then removed from the first portion, the internally threaded end of the nipple having an inside diameter larger than the outside maximum diameter of the swedge.

8. The hanger of claim 7 further comprising a coating of carbide particles on the outside of at least the first portion of the inner tubular.

9. A hanger for tubulars used in wells, comprising a nipple having a first portion of the length of the nipple being of increasing wall thickness in a first longitudinal direction, having a second portion of the length of the nipple being of decreasing wall thickness in the first longitudinal direction, the thicker ends of the first and second portions being closest to one another and having one end of the nipple being internally threaded, the one end being most adjacent the end of the first portion with a smaller wall thickness;

a swedge having an outside maximum diameter greater than the inside diameter of the inner tubular at least along a part of the first portion which, when in the first portion and displaced from the thicker end of the first portion, expands the inner tubular at the swedge beyond the yield point, the internally threaded end of the nipple having an inside diameter larger than the outside maximum diameter of the swedge.

10. The hanger of claim 9 further comprising a coating of carbide particles on the outside of at least the first portion of the inner tubular.

* * * * *